United States Patent [19]

Schmidt

[11] 4,049,202

[45] Sept. 20, 1977

[54] IMPACT HAMMER MILL

[75] Inventor: Horst Schmidt, Schildgen, Germany

[73] Assignee: KHD Industrieanlagen Ag, Germany

[21] Appl. No.: 718,332

[22] Filed: Aug. 27, 1976

[30] Foreign Application Priority Data

Mar. 4, 1976 Germany ..... 2608883

[51] Int. Cl.[2] ..... B02C 13/04

[52] U.S. Cl. ..... 241/30; 241/194; 241/197; 241/292

[58] Field of Search ..... 241/30, 189 R, 191, 241/194, 197, 292

[56] References Cited

U.S. PATENT DOCUMENTS

| | | | |
|---|---|---|---|
| 1,683,244 | 9/1928 | Duncan | 241/194 |
| 3,278,126 | 10/1966 | Ratkowski | 241/292 X |
| 3,844,494 | 10/1974 | Hightower | 241/194 X |
| 3,901,452 | 8/1975 | Loevenich | 241/197 |

FOREIGN PATENT DOCUMENTS

| | | | |
|---|---|---|---|
| 2,436,338 | 2/1976 | Germany | 241/191 |

*Primary Examiner*—Roy Lake
*Assistant Examiner*—Howard N. Goldberg
*Attorney, Agent, or Firm*—Hill, Gross, Simpson, Van Santen, Steadman, Chiara & Simpson

[57] ABSTRACT

A hammer mill has a plurality of hammer assemblies pivotally mounted about the periphery of a rotating rotor. Each hammer assembly has an arm portion connected to a pivot shaft and carrying a detachable head with slightly inclined impact surface. An equalization mass is attached to a rear side of the arm portion with its center of gravity rearwardly of a line between the center of gravity of the entire hammer assembly and the pivot shaft. As the material of the hammer wears away, the center of gravity of the assembly moves rearwardly, pivoting the hammer head forwardly under the centrifugal forces imposed. The wearing life of the head is increased and an optimum impact angle is maintained by the equalization weight. The head is made detachable from the arm but is positively locked during operation.

11 Claims, 3 Drawing Figures

IMPACT HAMMER MILL

BACKGROUND OF THE INVENTION

The invention relates to impact hammer mills having impact hammers arranged symmetrically about the periphery of a rotor on pivot shafts.

Hammers in impact hammer mills have short lives, particularly under heavy wear. Increasing wear of the hammer head in known mills reduces efficiency of comminution of materials. The impact effect of impact hammers is greatest when the impact surfaces of the hammers encounter squarely the material to be comminuted. With increasing wear of the impact hammer, however, the material to be comminuted is frequently only grazed by the worn impact hammer head. Then the material is centrifuged from the hammer and little comminution is accomplished by the worn heads.

The replacement of impact hammers in the previously known impact hammer mills requires relatively great effort and expense. The worn hammer together with its arm portion must be dismounted from the impact hammer mill and the replacement part installed. Such exchange of the entire impact hammer unit is very costly, particularly with impact hammer mills used in connection with tube mills or other aggregates. When the impact hammers are being repaired the other parts of the assembly line may also be interrupted.

The present invention substantially increases in a simple and effective manner the degree and efficiency of comminution and also the tool life.

On the hammer arm, an equalizing mass is arranged opposite the hammer head impact surface, viewed in the direction of rotation of the hammer and behind the common center of gravity line. With the aid of the equalizing mass arranged on the hammer arm, wearing of material from the hammer head rotates the hammer arm forward, in the direction of rotation of the rotor. The impact surface of the hammer head is thereby maintained in an angular position most favorable for comminution. Thus not only is the effectiveness of the hammer greatly improved but also the life of the hammer head is increased, since wear of the hammer head does not alter the angle of the impact surface. Then the impact hammer mill does not have to be taken out of operation so frequently to exchange worn hammer heads for new ones.

A further feature of the invention is that the hammer head and the hammer arm are so arranged with the equalization mass on the shaft, that the hammer impact surface lies a slight distance behind a parallel radial line of the rotor, at about 11° from a radial line of the rotor through the pivot shaft and center of gravity of the hammer assembly. This arrangement of the impact surface further improves the comminution effect of the impact hammer, since the impact surface will strike squarely onto the material to be comminuted.

In one embodiment of the invention, the hammer head has a recess which is U-shaped in cross-section, with a nose inside the U-shaped recess. The upper end of the hammer arm engages this U-shaped recess and is connected thereto by a retention device. The hammer head may be mounted from above or in front on the hammer arm and is positively connected thereto. Disassembly of the entire impact hammer assembly from the rotor is not necessary.

With this embodiment and arrangement of the hammer head on the hammer arm, the hammer head has inner surfaces of the U-shape engaged with corresponding countersurfaces of the arm to be held by centrifugal forces. This insures a reliable hold on the hammer head by the hammer arm. A simple stop device, consisting only of a bolt and a spring-clamp, secures the hammer head against unintentional release from the hammer arm upon starting and stopping. The bolt and the spring do not need to withstand the centrifugal force of the hammer head and are protected within the hammer arm from the adverse environment of the hammer mill.

DESCRIPTION OF THE PREFERRED EMBODIMENTS

Figure 1:
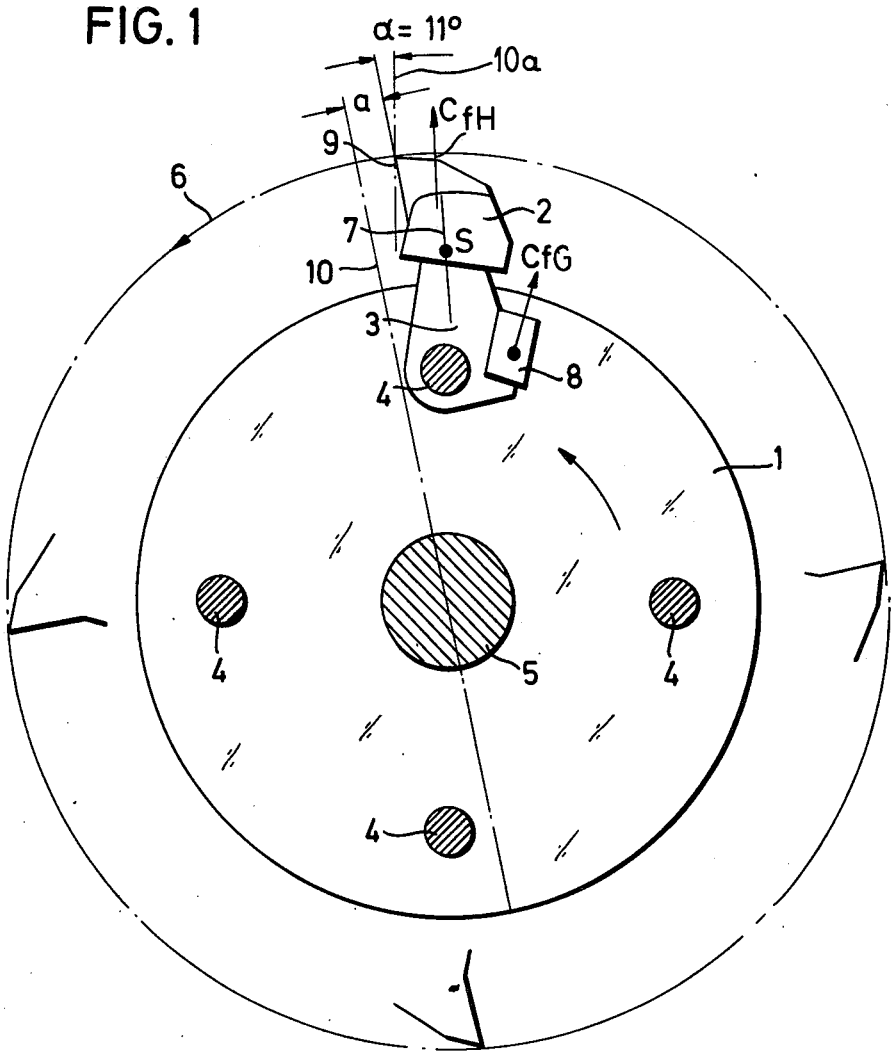
FIG. 1 is a side plan view of an impact hammer and rotor assembly, in partial section.

In FIG. 1, an impact hammer assembly arranged on the periphery of a rotor 1 has a hammer head 2 and a hammer arm portion 3. The arm 3 is positioned rotatably on a pivot shaft 4 fixed on the rotor 1. The rotor 1 is rotatably mounted on a drive-shaft 5. About the periphery of the rotor are arranged three other impact hammers (not shown in detail) uniformly distributed about the rotor on other shafts 4.

On the hammer arm 3, according to the invention, is provided an equalization mass 8 on a side opposite the hammer head 2 viewed in the direction of rotation 6 of the hammer heads and rotor and behind a line 7 connecting the center of gravity S of the hammer assembly with the pivot shaft 4. The equalization mass 8 introduces a centrifugal force $Cf_G$ during operation which produces a torsional or twisting movement directed forwardly of the hammer and in the direction of rotation of the hammer.

The equalization mass 8 on the arm portion 3 is arranged so that the impact hammer will assume the position shown in the drawing when the head 2 is new. The hammer head 2 and the hammer arm 3 with the equalization mass 8 are arranged on the shaft 4 so that a hammer impact surface 9 lies back a slight distance *a* behind a radial line 10 of the rotor drawn in a location just forward of the arm 3. The impact surface 9 forms an angle $\alpha$ of approximately 11° with a line 10*a* parallel to a line radial of the rotor and through the pivot axis 4 and the center of gravity of the assembly. An optimum comminution effect is attained by this configuration because the hammer head 2 and the impact surface 9 thereof squarely strike the material to be comminuted, thereby making the impact force of the hammer head fully effective.

Wear occurring on the hammer head 2 changes its angle because the material does not wear off uniformly but also changes the mass thereof with respect to that of the equalization mass 8. The torsional moment produced by the equalization mass 8 on the hammer arm 3 then increases relative to that of the hammer head 2. The arm is rotated forwardly (in the direction 6) and thereby the impact surface 9, even though its surface changes with wear, is maintained in the most favorable position for the comminution. The gradual change in position of the impact hammer under the influence of the equalization mass 8 continues during the operation of the mill until the wear part on the hammer head is consumed. In this manner, not only is a high degree of effectiveness of the impact hammer maintained, but also the life of the hammer head is greatly increased in comparison with the impact hammer mills of the prior art.

Figure 2:
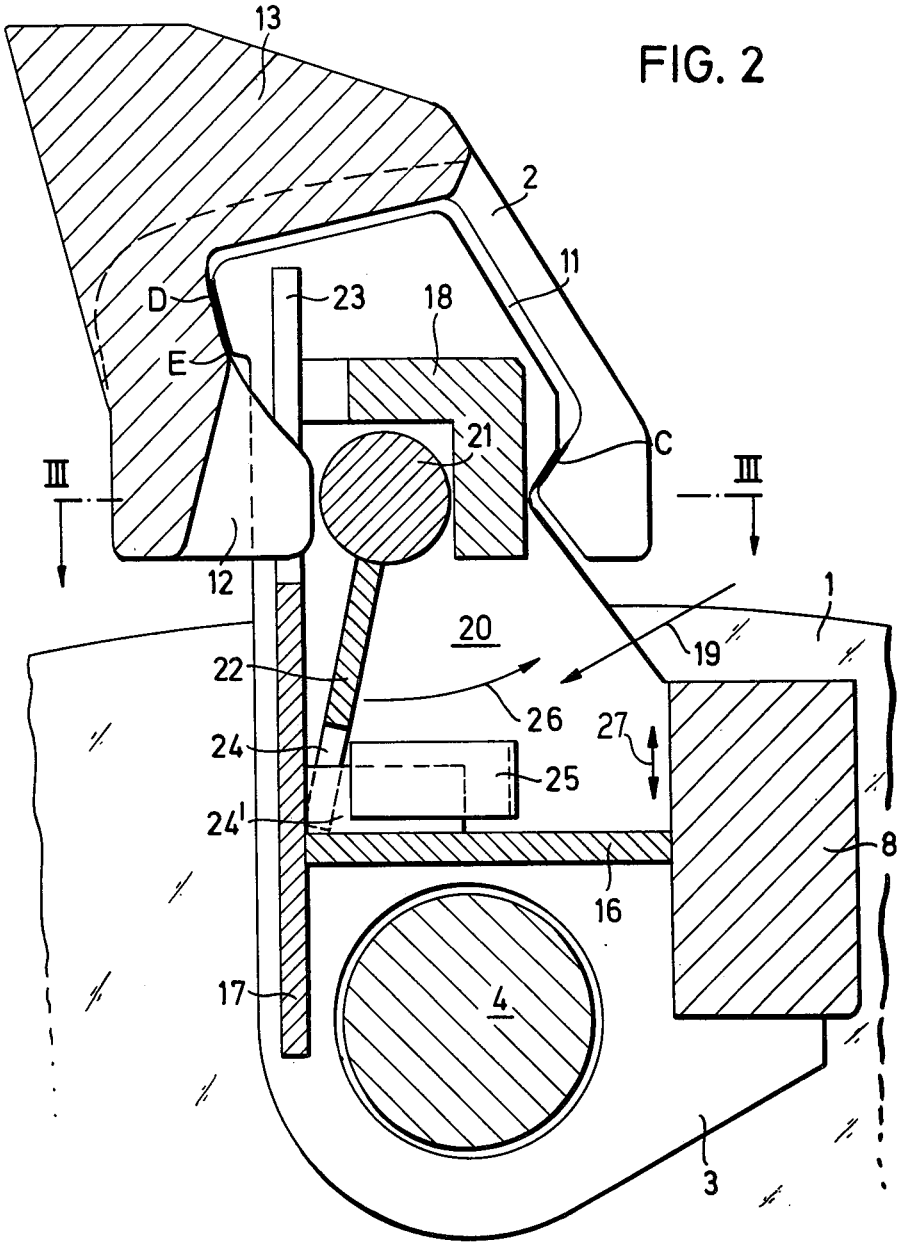
FIG. 2 is a side section through the impact hammer.
Figure 3:
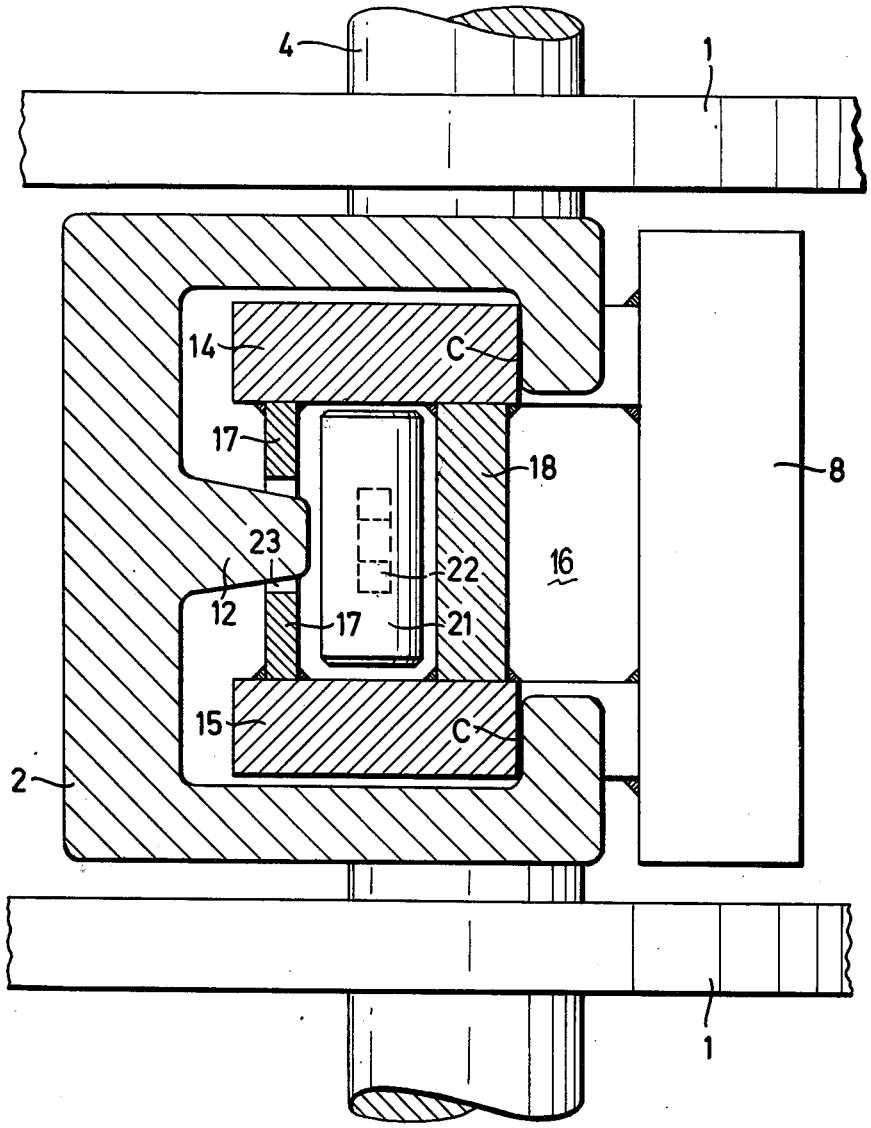
FIG. 3 is a top section view taken on line III—III of FIG. 2.

As shown in FIGS. 2 and 3, the hammer head 2 further has a recess 11 substantially U-shaped in cross-section. This U-shaped recess 11 engages an upper end of the hammer arm portion 3. The hammer head, particularly the part 13 of the hammer head 2 shown in dotted lines in the drawing, consists of materal highly resistant to impact wear, such as that known commercially as G-X 120 Mn 13. The hammer arm 3 comprises side members 14 and 15 which are connected with one another through mutually-perpendicular side bars or legs 16, 17 and the equalization mass 8. Spaced above the equalization mass 8 is also an angular beam 18. Between the lower edge of the beam 18 and the upper edge of the equalization mass 8 is formed a chamber 20 accessible from the outside as via the arrow 19 in FIG. 2.

Into the free chamber or space 20 is introduced a safety bolt 21 having a fishplate 22 extending therefrom, so that the head of the bolt 21 lies within the angularly-shaped beam 18 exactly at the height of a nose 12 on the hammer head 2 which projects into the U-shaped recess during assembly of the head 2 to the arm 3. The nose 12 projects through a slot-shaped opening 23 in the upper area of the bar or leg 17 and into the inner chamber 20 of the hammer arm. The handle or fishplate 22 has in its lower end a fork-shaped recess 24, which engages a vertically arranged bar or leg 24'. A spring clamp 25 engages the bar or leg 24' and holds tight the fishplate 22 of the safety bolt 21. The bolt 21 is supported on the bar or leg 16, and is prevented accordingly from rotating rearwardly.

The hammer head 2 is subjected to a centrifugal force $Cf_H$ which is resisted by surfaces C and D thereon within the U-shaped recess and the cooperating bearing surfaces of the hammer arm 3. Under the effect of the crushing-and centrifugal-forces occurring upon the comminution, a rearwardly-directed twisting-or torsional-movement is produced on the hammer head, which makes impossible any release of the hammer head 2 from the surfaces of the hammer arm 3. Thus a particularly simple mounting of the hammer head is obtained.

When the wear part 13 of the hammer head 2 is consumed, the hammer head is replaced. After release of the spring-clamp 25 from the bar or leg 24', the fishplate 22 of the safety bolt 21 is swung rearwardly. The safety bolt may then be removed from the hammer arm in direction of arrow 26, to the rear. Subsequently the top of the hammer head 2 is tilted forwardly about a point E, in the direction of the rotor, to disengage the retention surfaces C and D. The head 2 is then lifted out. Replacement follows a reverse procedure.

Through this releasable connection of the hammer head with the hammer arm in accordance with the invention, an exchange or replacement of the hammer head may be carried out in very short time within the impact-hammer-mill with only slight effort and consequent expense.

The subject matter according to the invention is not limited to the embodiment shown by way of example in the drawings. Thus, the impact hammer according to the invention may be installed relatively quickly on known impact hammer mills. The equalization mass 8 arranged on the hammer arm may also be arranged to be slidable upwardly or downwardly as shown by arrowed line 27, in order thereby to be able to exert influence on the particularly desired position of the hammer as well as of the hammer wear parts. This can be done by suitable adjustment mechanism, not shown.

Although these and various other minor modifications may be suggested by those versed in the art, it should be understood that I wish to embody within the scope of the patent warranted hereon all such modifications as reasonably and properly come within the scope of my contribution to the art.

I claim as my invention:

1. An impact hammer mill apparatus comprising:
   at least two hammer assemblies having arm portions and equalization masses, the hammers being arranged symmetrically about a periphery of said rotor;
   each of said hammer assemblies being pivotable about a pivot axis through its respective arm and parallel to and offset from said rotor axis;
   each of said hammers having a wearing head with an impact surface facing in the general direction of rotation of the rotors; and
   each said equalization masses being affixed to a side of the arm portion of each of said hammers circumferentially opposite the impact surface of the head thereof and having a center of gravity behind a radial line connecting the pivot axis with the rotor axis, with respect to the direction of rotation of the rotor, whereby the impact surface of the head is maintained in an optimum impact orientation, despite wear thereof, by centrifugal forces acting upon the equalization mass and the wearing head.

2. An impact hammer mill apparatus as defined in claim 1:
   wherein said impact surface extends parallel to but is offset behind a line radial to said rotor and just forwardly of said hammer assembly in an operating position.

3. An impact hammer mill apparatus as defined in claim 2:
   wherein said impact surface extends at an angle of about 11° to a line raidal of said rotor through a center of gravity of said hammer assembly.

4. An impact hammer mill apparatus as defined in claim 1:
   wherein each said wearing head is removably engagable with its respective arm portion, said head contacting said arm portion at a pair of cooperating retention surfaces on each of said head and said arm portion, and each of said retention surfaces being inclined relative to a line radial to said rotor and planes thereof intersecting one another between said head and said pivot axis.

5. An impact hammer mill apparatus as defined in claim 4:
   wherein said apparatus further comprises impact head locking means comprising:
   a safety bolt having an enlarged head and a handle portion with a foot opposite said enlarged head;
   a pair of L-shaped transverse beams in said arm portion, the beams defining two opposite corners of a rectangle between which said head and said foot are receivable;
   a clamp means for removably retaining said foot in its respective corner of said rectangle;
   a nose on said hammer head received temporarily within said arm portion in a space to be occupied by said bolt head, the nose entering the space during attachment of the hammer head to the arm portion, and said bolt head and nose obstructing removal of said hammer head after assembly thereof.

6. An impact hammer mill apparatus as defined in claim 5:

wherein said hammer head has a U-shape into which the arm portion is received.

7. An impact hammer assembly affixed pivotally on a shaft on a rotor rotating in a direction, the shaft being offset from an axis of rotation of the rotor, and the hammer assembly comprising:

an arm portion received on said pivot shaft and having a radially outward end;

an impact head portion detachably received on said end of said arm portion radially outward of said shaft;

an impact surface carried on said head portion and facing generally in said direction of rotation of said rotor; and an equalization mass carried on said arm rearwardly of a line between said shaft and a center of gravity of said hammer assembly with respect to said direction of rotation of the rotor.

8. An impact hammer mill apparatus as defined in claim 7:

wherein said impact surface is inclined at about 11° to a line radial to said rotor and through said pivot shaft, a plane defined by the impact surface intersecting the radial line radially inwardly of the impact surface with respect to the rotor.

9. An impact hammer apparatus as defined in claim 7, further comprising:

a pair of retention surfaces formed on a U-shaped base of the head and a pair of cooperating surfaces on said arm portion by which said head portion is removably engaged to the arm portion;

a nose on the head portion extending inwardly of said base and arm portions, the head being received initially on a forward one of said retention surfaces of said arm portion with said nose inserted into the arm portion and then being pivotable about said forward surface to engage a rearward one of said surfaces with the arm portion; and an obstructing member received in said arm portion to block reverse pivoting and removal of the head portion from the arm.

10. The method of correcting for wear of a hammer face on a hammer assembly of an impact hammer mill comprising:

mounting the hammer assembly on the rotor with the wearable hammer surface facing in the direction of rotation, and mounting an equalization mass on the hammer arm circumferentially offset from the axis of the hammer arm so that as the hammer face wears the equalization mass will cause the hammer arm to pivot and maintain the hammer face in an optimum position relative to the rotor.

11. An impact hammer mill apparatus comprising:

a hammer mill rotor;

a hammer assembly having an arm portion pivotally mounted on the periphery of the rotor;

an impact hammer mounted on the arm having a wearing surface facing in the direction of rotation of the rotor;

and an equalization mass carried on said arm circumferentially offset from the pivotal axis of the rotor so that said mass applies a centrifugal force to the arm during rotation with said mass positioned to change the angular position of the arm on the rotor with wear of the hammer face and reduction of weight of the hammer so that the face maintains an optimum impact orientation despite wear thereof.

* * * * *